US007762223B2

(12) United States Patent
Christgen et al.

(10) Patent No.: US 7,762,223 B2
(45) Date of Patent: Jul. 27, 2010

(54) VALVE TRAIN OF AN INTERNAL COMBUSTION ENGINE

(75) Inventors: Wolfgang Christgen, Seukendorf (DE); Thomas Kern, Dormitz (DE)

(73) Assignee: Schaeffler KG, Herzogenaurach (DE)

( * ) Notice: Subject to any disclaimer, the term of this patent is extended or adjusted under 35 U.S.C. 154(b) by 305 days.

(21) Appl. No.: 12/079,058

(22) Filed: Mar. 24, 2008

(65) Prior Publication Data

US 2008/0245327 A1 Oct. 9, 2008

(30) Foreign Application Priority Data

Apr. 7, 2007 (DE) ..... 10 2007 016 752

(51) Int. Cl.
*F01L 1/18* (2006.01)

(52) U.S. Cl. ..... 123/90.39; 123/90.44; 123/90.46; 74/569

(58) Field of Classification Search ..... 123/90.39, 123/90.44, 90.46, 90.48, 90.52, 90.55; 74/559, 74/567, 569; 403/114, 165, 166
See application file for complete search history.

(56) References Cited

U.S. PATENT DOCUMENTS 3,500,810 A 3/1970 Thompson
7,568,459 B2 * 8/2009 Best ..... 123/90.39

FOREIGN PATENT DOCUMENTS

| | | | |
|---|---|---|---|
| DE | 3343324 | A1 | 6/1984 |
| DE | 19741078 | A1 | 3/1999 |
| DE | 19838926 | A1 | 3/2000 |
| JP | 2004076707 | A | 3/2004 |

* cited by examiner

*Primary Examiner*—Ching Chang
(74) *Attorney, Agent, or Firm*—Charles A. Muserlian

(57) ABSTRACT

A valve train (1) of an internal combustion engine (2), said valve train (1) comprising a support element (10) and a finger lever (5) or a rocker arm for operating a gas exchange valve, said finger lever (5) or rocket arm comprising a joint socket (8) comprising a semispherical portion (12) for mounting the finger lever (5) or rocker arm on a joint head (9) of the support element and further comprising, adjacent to the semispherical portion, a depression (13) from which a spray bore (20) starts to extend through the joint socket, the spray bore (20) is in hydraulic communication with a supply bore (19) that extends through the joint head which provides a valve body (15*a*, 15*b*) that is arranged for displacement in the depression and comprises a projection (18), so that, in the closed position of the gas exchange valve, the spray bore and the supply bore are substantially or entirely separated hydraulically from each other by a snapping of the projection into the supply bore.

5 Claims, 4 Drawing Sheets

VALVE TRAIN OF AN INTERNAL COMBUSTION ENGINE

FIELD OF THE INVENTION

The invention concerns a valve train of an internal combustion engine, said valve train comprising a stationary support element that is mounted in the internal combustion engine and further comprising a finger lever or a rocker arm for a stroke-operation of a gas exchange valve between a closed position and an open position. The finger lever or rocket arm comprises a joint socket comprising a semispherical portion for a pivotal mounting of the finger lever or rocker arm on a spherical joint head of the support element and further comprising, adjacent to the semispherical portion, a depression from which a spray bore starts to extend through the joint socket for transporting hydraulic medium to a contact surface of the finger lever or rocker arm for contact with a valve train component that drives the finger lever or rocker arm. This spray bore is in hydraulic communication with a supply bore that, downstream of a hydraulic medium supply connected to the support element, extends through the joint head and opens within the joint socket.

BACKGROUND OF THE INVENTION

DE 42 34 868 C2 discloses a valve train comprising a finger lever that is mounted at one end through a ball-and-socket joint formed by a joint socket and a spherical joint head of a support element that is connected to a hydraulic medium supply of the internal combustion engine. The finger lever comprises a spray bore extending through the joint socket for lubricating and/or cooling a driven contact surface of the finger lever—in this document, a roller actuated by a cam of a camshaft. Pressurized hydraulic medium from the hydraulic medium supply is transported through a hydraulic medium passage extending within the support element via a supply bore in the joint head into a depression of the joint socket situated adjacent to the semispherical portion and leaves this through the spray bore that is directed toward the roller. The hydraulic medium serves at the same time for the lubrication of the joint contact region between the joint head and the joint socket.

In this configuration, the spray bore and the supply bore are in permanent hydraulic communication with each other, so that, during the operation of the internal combustion engine, the roller is permanently sprayed irrespective of the stroke position of the gas exchange valve. A drawback arising from this is the hydraulic medium stream that is required alone for this spraying and that, particularly in the case of multi-valve internal combustion engines, can add up to form a considerable share in the delivery flow from the hydraulic medium supply, i.e. in the drive performance of the hydraulic medium pump, and can thus constitute a larger contribution to the so-called mean friction pressure as a measure of the power dissipation of the internal combustion engine that is always to be kept as low as possible.

The above discussion applies equally to valve trains known to a person of ordinary skill in the art comprising a rocker arm which, in length direction of its arm, has a central joint socket in place of an end joint socket and is mounted through a ball-and-socket joint on a joint head of a so-called suspended support element.

OBJECTS OF THE INVENTION

An object of the present invention is therefore to improve a valve train of the pre-cited type, so that the mentioned drawback is eliminated using simple measures. A first measure serving this purpose is to effect the spraying of the contact surface with hydraulic medium so as to match the operation of the valve train to the operating life demands on the internal combustion engine without premature surface wear in the valve train. Having regard to the delivery flow from the hydraulic medium supply, a second measure is to keep the power dissipation of the internal combustion engine concomitant with the spraying as low as possible.

This and other objects and advantages of the invention will become obvious from the following detailed description.

SUMMARY OF THE INVENTION

The invention achieves the above objects by the fact that a valve body is arranged in the depression for displacement with an outer peripheral surface on the inner peripheral surface of the depression and is biased by gravitational force and/or by a force of a spring means towards the socket head and comprises a projection cooperating with the supply bore such that, in the closed position of the gas exchange valve, the spray bore and the supply bore are substantially or entirely separated hydraulically from each other by a snapping of the projection into the supply bore. Advantageous developments and embodiments of the invention are also described below.

The present invention is thus based firstly on the fact that a valve body is forced to participate in the pivoting motion of the finger lever or rocker arm and that a projection of the valve body is snapped into the supply bore in the closed position of the gas exchange valve and closes the supply bore substantially or entirely for the purpose of reducing or interrupting the hydraulic medium flow through the spray bore. Secondly, a pivoting of the finger lever or rocker arm with the concomitant opening of the gas exchange valve forces the projection out of the then opened supply bore and thus causes a displacement of the valve body in the depression. Due to the open state of the supply bore, a pulsating hydraulic medium flow takes place through the spray bore during a work cycle made up of an opening phase and a closing phase of the gas exchange valve and, as will be described below in connection with further developments of the invention, the characteristic of this pulsation can also be modified. But, in any case, the forced pivoting of the valve body leads to a snapping-in or snapping-out of the projection into or out of the supply bore, depending on the position of the gas exchange valve, so that the hydraulic medium flow through the supply bore and, thus also, through the spray bore, at least in the closed position of the gas exchange valve, is considerably throttled or completely interrupted.

The potential of reduction of frictional loss in the internal combustion engine created by the cyclic throttling or interruption of hydraulic medium flow results from the reduction of the mean delivery flow of the hydraulic medium pump. Thus, for example, for valve timings of a gas exchange valve that is closed through 480° crankshaft angle and open through 240° crankshaft angle with a cyclically completely shut off spraying, the hydraulic medium flow required for spraying is reduced by two thirds of the original amount required for permanent spraying.

According to a further development of the invention, the contact surface of the finger lever or rocker arm is configured as a plain bearing-mounted or a rolling bearing-mounted roller. Alternatively, the contact surface for the valve train component that actuates the finger lever or rocker arm can also be rigidly configured on the finger lever or rocker arm. This valve train component is preferably configured as a cam of a camshaft. However, the valve train component actuating the lever finger or rocker arm may itself also be a lever, for instance, a lever forming a part of fully variable mechanic valve lift controls as contemporarily used under the name of "valvetronic" in series production of automobiles of the company of BMW.

According to a further proposition of the invention, the inner peripheral surface of the depression and the outer peripheral surface of the valve body widen into a frustoconical shape towards the joint head and are spaced from each other in the closed position of the gas exchange valve by a radial clearance, while, in the open position of the gas exchange valve, the spray bore and the supply bore are hydraulically separated from each other by a sealing gap between the inner peripheral surface and the outer peripheral surface. The resulting advantages are related, on the one hand, to the manufacturing of the joint socket because the frustoconical depression can be made, preferably by stamping, using a tool of distinctly higher durability than would be possible, for example, in the case of a cylindrical depression. On the other hand, the mutual sealing action of the depression and the valve body, even in the open position of the gas exchange valve, and, more precisely, in its position of maximum opening, leads to a further throttling or interruption of the hydraulic medium flow through the spray bore. More specifically, this means that a noteworthy spraying of the contact surface of the finger lever or rocker arm takes place only in the transition phase from the closed position to the position of maximum opening of the gas exchange valve, so that a further reduction of hydraulic medium flow to be delivered by the hydraulic medium pump can be obtained.

Finally, as an alternative to this quasi two-fold pulsation of the hydraulic medium flow during a work cycle of the gas exchange valve, the inner peripheral surface of the depression and the outer peripheral surface of the valve body are likewise configured with a frustoconical widening towards the joint head and are spaced from each other by a radial clearance during the closed position of the gas exchange valve but, in the open position of the gas exchange valve, the spray bore and the supply bore are hydraulically connected to each other at least through one longitudinal recess extending on said inner peripheral surface and/or on said outer peripheral surface. In this case, the tool-favorable shaping method of the frustoconical depression is retained but the hydraulic medium flow through the spray bore is not interrupted over the entire opening phase of the gas exchange valve.

It goes without saying that, as far as possible and useful, any of the aforesaid features and developments of the invention may also be used in any desired combination with one another.

BRIEF DESCRIPTION OF THE DRAWINGS

Further features of the invention will result from the following description and from the drawings in which examples of embodiment of the invention are represented in a partially simplified manner. If not otherwise stated, identical or functionally similar features or components are identified by the same reference numerals.

DETAILED DESCRIPTION OF THE DRAWINGS

Figure 5:
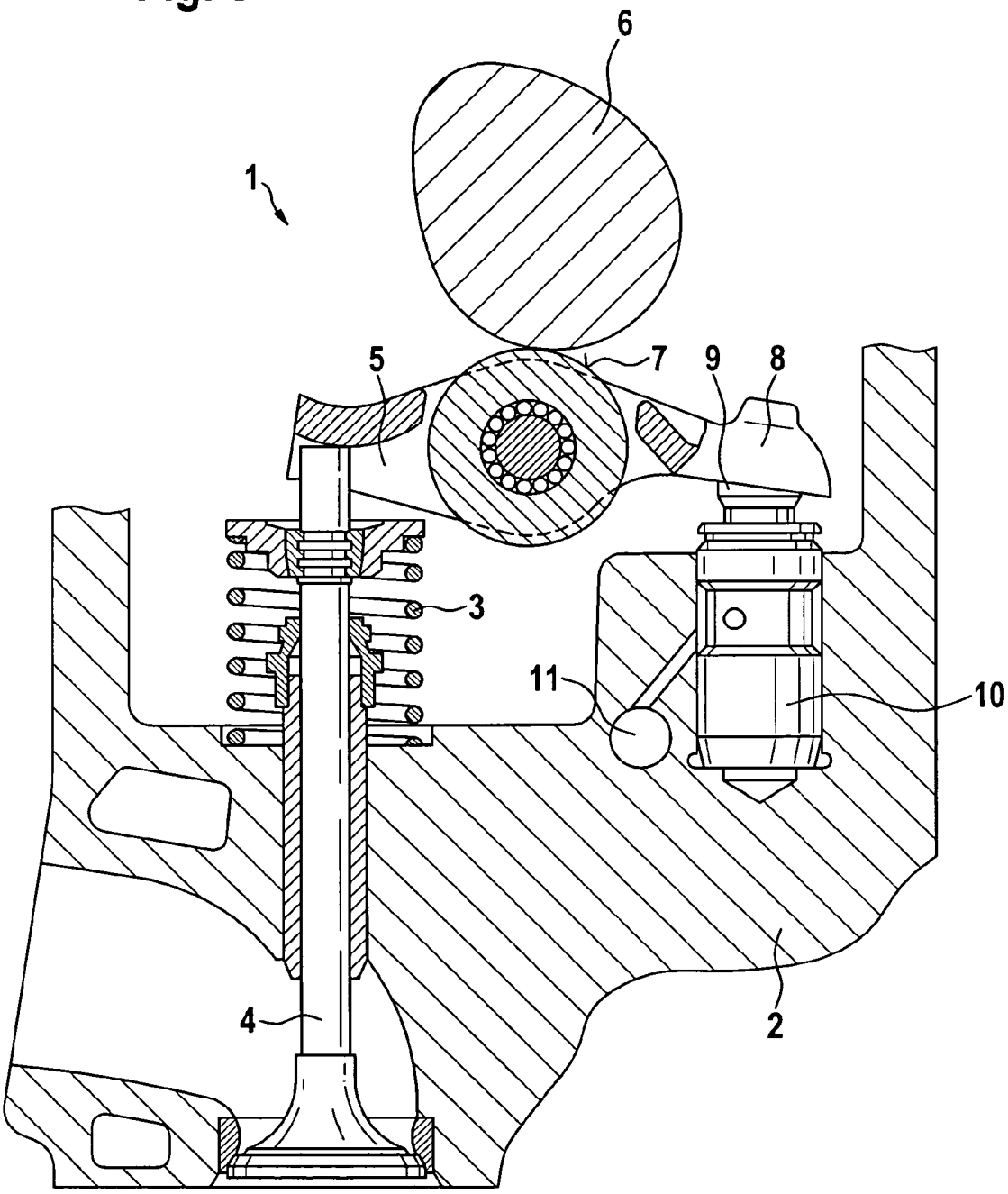
FIG. 5, is a general view of a prior art valve train that will be helpful for explaining the invention.

FIG. 5 shows a general view of a valve train 1 of an internal combustion engine 2 known, per se, to a person of ordinary skill in the art and which is helpful for the understanding of the invention that is described in detail in the following. A gas exchange valve 4 biased by the force of a valve spring 3 in closing direction is stroke-operated by a finger lever 5 between its represented closed position and an open position. For this purpose, the finger lever 5 that is driven by a valve train component 6, configured in the present case as a cam of a camshaft, comprises a roller which is mounted in this case on a rolling bearing and constitutes a low-friction contact surface 7 for the cam 6. The finger lever 5 is pivoted through an end-side joint socket 8 on a spherical joint head 9 of a support element 10 that is fixedly mounted on the internal combustion engine 2. The support element 10 that is connected to a hydraulic medium supply 11 symbolized by the hydraulic medium gallery comprises a hydraulic valve lash adjuster of a known type for an automatic lash adjustment. According to the invention, a part of the hydraulic medium delivered to the support element 10 leaves the joint socket 8 in the form of a pulsating stream or a pulsating spray that is applied to the roller for the purpose of lubrication and/or cooling.

Figure 1:
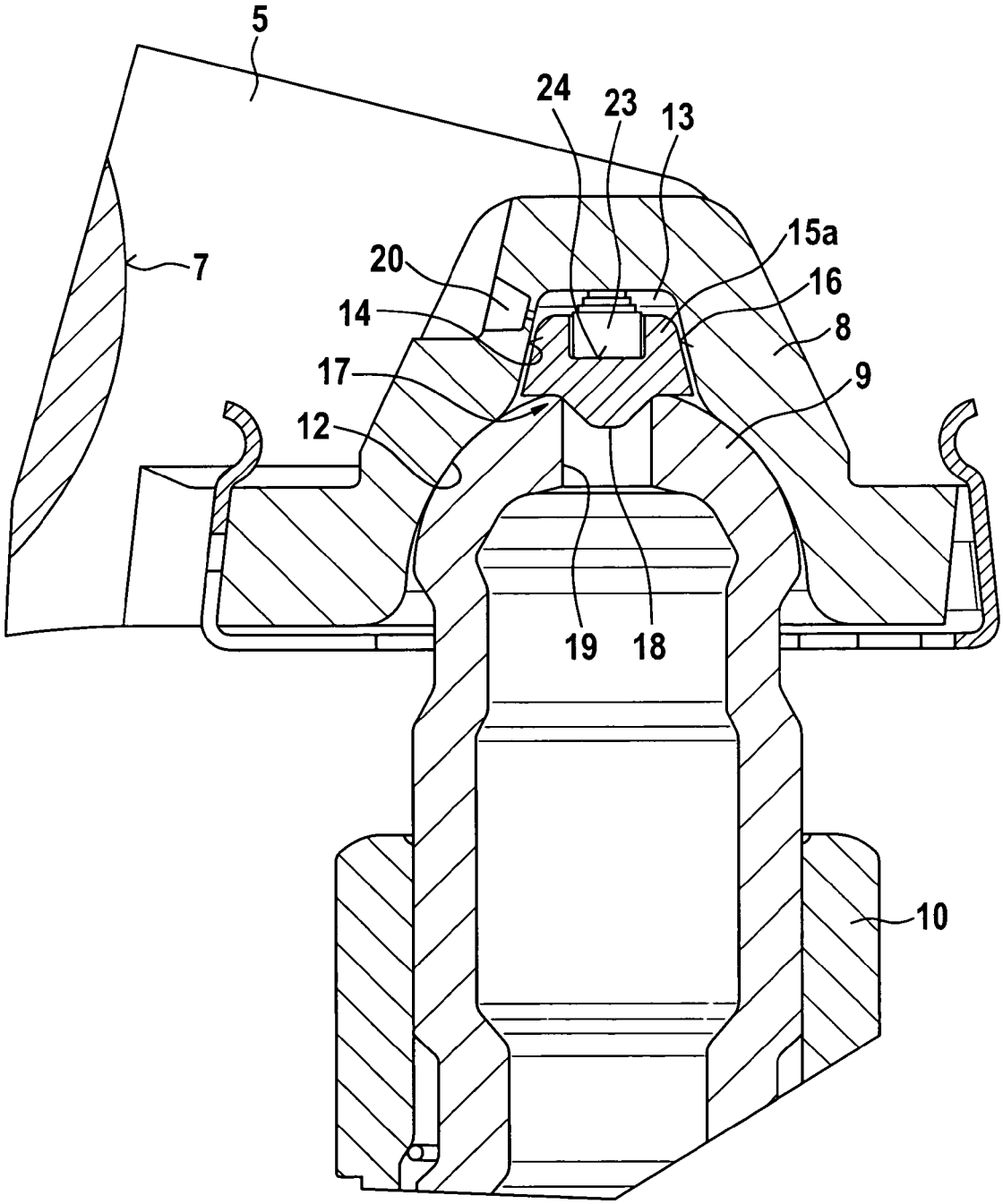
FIG. 1, shows a portion of a first example of embodiment of the inventive valve train that is helpful for an overall understanding of the invention.

The inventive means for creating this pulsation of the hydraulic medium stream or spray will now be explained with reference to the appended figures. FIG. 1 shows a first example of embodiment of the invention in a highly enlarged longitudinal sectional view through the joint socket 8 of the finger lever 5, made in this example as a shaped sheet metal part, and through the joint head 9 of the support element 10. The joint socket 8 comprises, in its interior, a semispherical portion 12 as a contact partner for the spherical joint head 9 as also, adjoining this, a depression 13 whose inner peripheral surface 14, for assuring a better durability of a shaping tool for the depression 13, has a frustoconical configuration. An outer peripheral surface 16 of a valve body 15*a* arranged in the depression 13 likewise has a frustoconical shape and is complementary to the inner peripheral surface 14 of the depression 13. On its front end 17 oriented towards the joint head 9, the valve body 15*a* comprises a projection 18, in the present case, with a spherical configuration, which, in the illustrated position of finger lever 5 relative to the support element 10, corresponding to the closed position of the gas exchange valve 4, is snapped into a hydraulic medium supply bore 19 extending in the joint head 9 and substantially or completely closes this supply bore 19. By the term "substantially" is to be understood that a small throttling cross-section can also remain between the projection 18 and the supply bore 19. Such a throttling cross-section can be generated, for example, by an appropriate surface configuration including e.g. notches, beads or the like on the projection 18 or on the supply bore 19.

The supply bore 19 that branches off the valve lash adjuster of the support element 10 downstream of the hydraulic medium supply 11, is known, as such, in the prior art and serves, on the one hand, to transport hydraulic medium into the joint contact region between the joint socket 8 and the joint head 9 and, on the other hand, to convey to the roller 7 hydraulic medium that leaves the joint socket 8 as a stream or spray out of a spray bore 20 extending through the joint socket 8. It is the function of the valve body 15*a* to control, in accordance with the position of the gas exchange valve 4, the intensity of the hydraulic medium stream or spray leaving the spray bore 20. This control function is explained below with reference to FIGS. 2 and 3 in which the relative positions of the joint socket 8 and the joint head 9 are schematically represented, respectively, in the closed position of the gas exchange valve 4 and at a maximum opening of the gas exchange valve 4.

Figure 2:
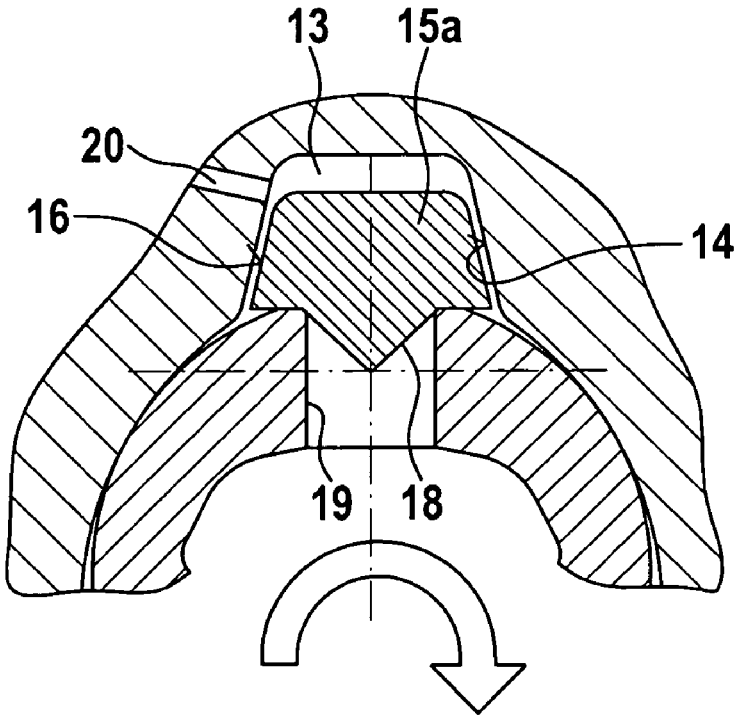
FIG. 2, shows one step in the mode of functioning of the valve train of FIG. 1, in a schematic representation.

In the relative position illustrated in FIG. 2 and identical to the position shown in FIG. 1, the projection 18 of the valve body 15*a* is snapped into the supply bore 19 and closes this completely, so that the spray bore 20 and the supply bore 19 are hydraulically separated from each other. As a result, the hydraulic medium flow through the spray bore 20 is interrupted in the closed position of the gas exchange valve 4. This figure also clearly shows the radial clearance that is required for the subsequent displacement of the frustoconical valve body 15*a* and is formed in this relative position between the inner peripheral surface 14 of the depression 13 and the outer peripheral surface 16 of the valve body 15*a*.

Figure 3:
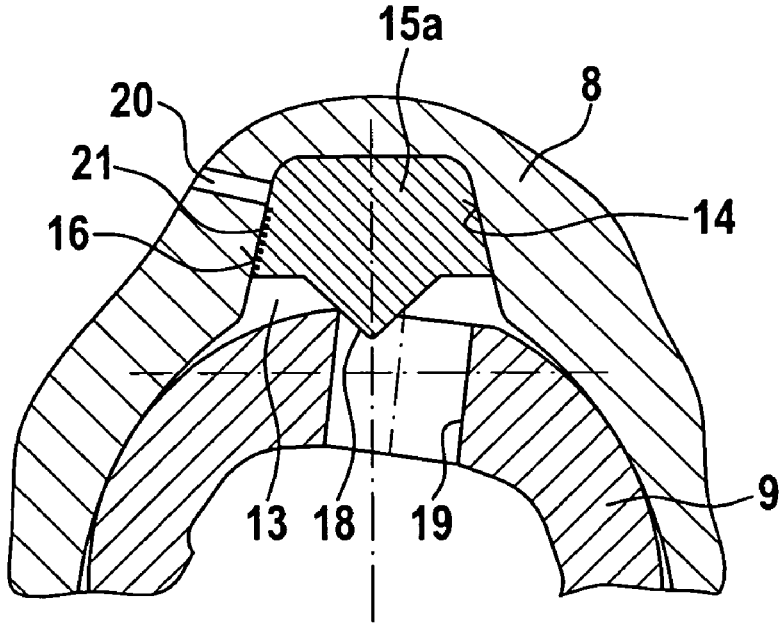
FIG. 3 shows another step in the mode of functioning of the valve train of FIG. 1, in a schematic representation.

The relative position of the joint socket 8 and the joint head 9 shown in FIG. 3 corresponds to the position of maximum opening of the gas exchange valve 4 and thus to the maximum displacement of the valve body 15*a* in the depression 13. The displacement results from the fact that, upon opening of the gas exchange valve 4, the joint socket 8 pivots relative to the joint head 9 and acts via the inner peripheral surface 14 of the depression 13 on the outer peripheral surface 16 of the valve body 15*a* through the projection 18 which, due to its shape, is driven out of the supply bore 19 and opens this. This means that the spray bore 20 and the supply bore 19 are connected hydraulically to each other with the creation of the hydraulic medium stream or spray out of the spray bore 20 only in the intermediate relative positions, not illustrated, that correspond to the opening and closing phases of the gas exchange valve 4 between its closed position and its position of maximum opening. In other words, the hydraulic medium flow through the spray bore 20 is interrupted not only in the closed position of the gas exchange valve 4 shown in FIG. 2, but also in the position of maximum opening of the gas exchange valve 4 shown in the FIG. 3 because, in this position, the outer peripheral surface 16 of the valve body 15*a* and the inner peripheral surface 14 of the depression 13 are in osculating relationship with each other with the formation of a sealing gap 21, shown as a dotted line, between the spray bore 20 and the supply bore 19. As a consequence, this configuration gives rise to the aforesaid two-fold pulsation of the hydraulic medium flow during each work cycle of the gas exchange valve 4.

Figure 4:
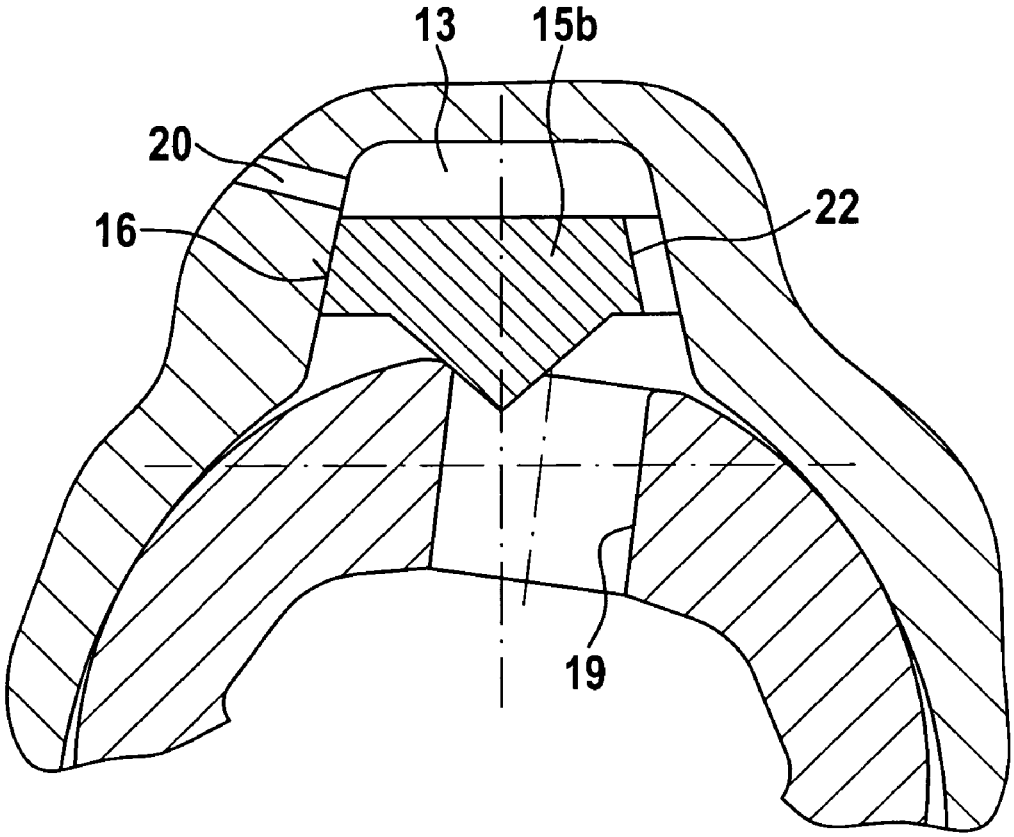
FIG. 4, shows a portion of a second example of embodiment of the inventive valve train, in a schematic representation

FIG. 4, showing a likewise schematically represented second example of embodiment of the invention, discloses that it can also be desirable to interrupt or at least clearly throttle the hydraulic medium flow through the spray bore 20 only in the closed position of the gas exchange valve 4. In this case, the outer peripheral surface 16 of a valve body 15*b* is interrupted by a longitudinal recess 22 extending therein, so that, even with a maximum displacement of the valve body 15*b* in the depression 13, corresponding to the position of maximum opening of the gas exchange valve 4, the spray bore 20 and the supply bore 19 are connected hydraulically to each other and an uninterrupted hydraulic medium stream or spray out of the spray bore 20 exists during the entire opening phase of the gas exchange valve 4.

Finally, attention may also be drawn to a spring means 23 shown in FIG. 1 that is configured, in the present example, as a compression spring clamped between the bottom of the depression 13 and a cavity 24 of the valve body 15*a* oriented away from the joint head 9. The function of the spring means 23 is not only to effect a rapid snapping-in of the projection 18 into the supply bore 19 when the closed position of the gas exchange valve 4 is attained but also to assure an adequate closing of the supply bore 19 against the pressure force of the hydraulic medium in the supply bore 19. Further, such a spring means is an absolute requirement in valve trains comprising rocker arms and support elements arranged by suspension in the internal combustion engine if, in the usual position of installation of the valve train, the gravitational force acting on the valve body would bias the valve body away from the joint head of the support element and the desired closing of the supply bore were not guaranteed.

LIST OF REFERENCE NUMERALS

1 Valve train
2 Internal combustion engine
3 Valve spring
4 Gas exchange valve
5 Finger lever
6 Valve train component/cam
7 Contact surface/roller
8 Joint socket
9 Joint head
10 Support element
11 Hydraulic medium supply
12 Semispherical portion
13 Depression
14 Inner peripheral surface of the depression
15*a* Valve body
15*b* Valve body
16 Outer peripheral surface of the valve body
17 Front end of the valve body
18 Projection
19 Supply bore
20 Spray bore
21 Sealing gap
22 Longitudinal recess
23 Spring means
24 Cavity of the valve body

The invention claimed is:

1. A valve train of an internal combustion engine, said valve train comprising a stationery support element that is mounted in the internal combustion engine and further comprising a finger lever or a rocker arm for a stroke-operation of a gas exchange valve between a closed position and an open position, said finger lever or rocket arm comprising a joint socket comprising a semispherical portion for a pivotal mounting of the finger lever or rocker arm on a spherical joint head of the support element and further comprising, adjacent to the semispherical portion, a depression from which a spray bore starts to extend through the joint socket for transporting hydraulic medium to a contact surface of the finger lever or rocker arm for contact with a valve train component that drives the finger lever or rocker arm, said spray bore being in hydraulic communication with a supply bore that, downstream of a hydraulic medium supply connected to the support element, extends through the spherical joint head and opens within the joint socket, wherein a valve body that is arranged in the depression for displacement with an outer peripheral surface on an inner peripheral surface of the depression and is biased by gravitational force and/or by a force of a spring means towards the spherical joint head and comprises a projection cooperation with the supply bore, so that, in the closed position of the gas exchange valve, the spray bore and the supply bore are substantially or entirely separated hydraulically from each other by a snapping of the projection into the supply bore.

2. The valve train of claim 1, wherein the contact surface of the finger lever or rocker arm is configured as a plain bearing-mounted or a rolling bearing-mounted roller.

3. The valve train of claim 1, wherein the valve train component that drives the finger lever or rocker arm is configured as a cam of a camshaft.

4. The valve train of claim 1, wherein the inner peripheral surface of the depression and the outer peripheral surface of the valve body widen into a frustoconical shape towards the joint head and are spaced from each other in the closed position of the gas exchange valve by a radical clearance, while, in the open position of the gas exchange valve, the spray bore and the supply bore are hydraulically separated from each other by a sealing gap between the inner peripheral surface and the outer peripheral surface.

5. The valve train of claim 1, wherein the inner peripheral surface of the depression and the outer peripheral surface of the valve body widen into a frustoconical shape towards the joint head and are spaced from each other in the closed position of the gas exchange valve by a radical clearance, while, in the open position of the gas exchange valve, the spray bore and the supply bore are hydraulically connected to each other at least through one longitudinal recess extending on the inner peripheral surface and/or on the outer peripheral surface.

* * * * *